United States Patent [19]

Cook

[11] Patent Number: 4,874,109

[45] Date of Patent: Oct. 17, 1989

[54] CAN HOLDER

[76] Inventor: John L. Cook, 23638 Anza Ave., Ste. E, Torrance, Calif. 90505

[21] Appl. No.: 263,544

[22] Filed: Oct. 27, 1988

[51] Int. Cl.[4] ..... B65D 7/42

[52] U.S. Cl. ..... 220/94 R; 220/85 H; 220/90.2; 215/100 A; 294/30

[58] Field of Search ..... 220/85 D, 85 H, 94 R; 215/100 A; 294/30, 29, 31.1, 33, 31.2

[56] References Cited

U.S. PATENT DOCUMENTS

| | | | |
|---|---|---|---|
| 2,742,315 | 12/1950 | Dreier | 294/29 |
| 3,088,767 | 5/1963 | Deal | 220/94 R |
| 3,692,346 | 12/1972 | Simms | 220/85 H |
| 4,463,978 | 8/1984 | Mountain | 294/31.2 |
| 4,560,193 | 12/1985 | Beebe | 294/31.2 |

*Primary Examiner*—George E. Lowrance
*Assistant Examiner*—G. W. Reece
*Attorney, Agent, or Firm*—Ashen, Golant, Martin & Seldon

[57] ABSTRACT

A can holder that can be molded from plastic, preferably in two sections. One section comprises a collar for fitting around a container such as an aluminum can, said collar has two lugs on its outer surface and a locking tab in the collar between the lugs. The other section is a handle which can be mounted rotatably between the lugs so that when the handle is in a raised position the collar may be slipped over or removed from the container and when the handle is depressed, a camming face on the end nearest the container is pressed against the locking tab and holds the container securely.

8 Claims, 1 Drawing Sheet

Fig. 1.
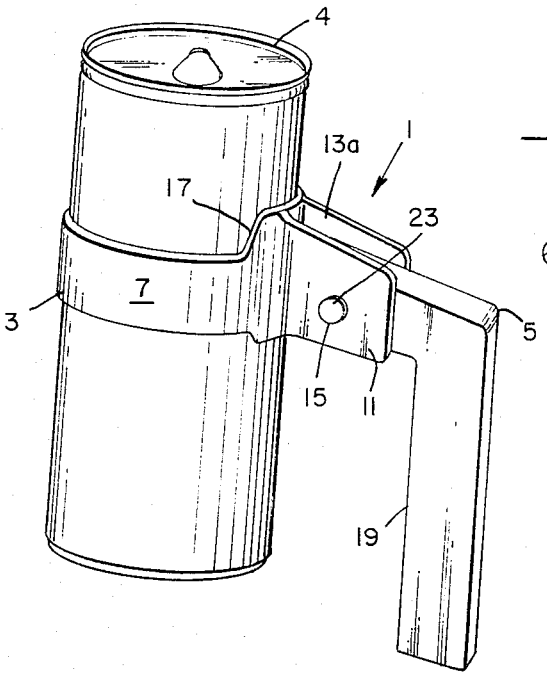
Fig. 2.
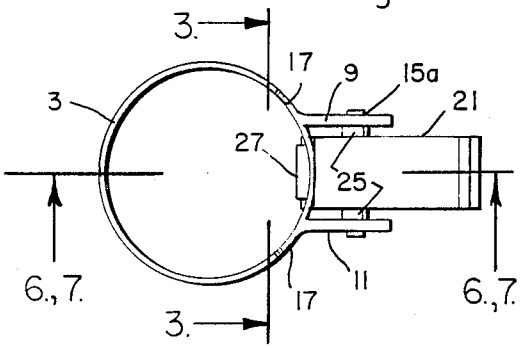
Fig. 3.
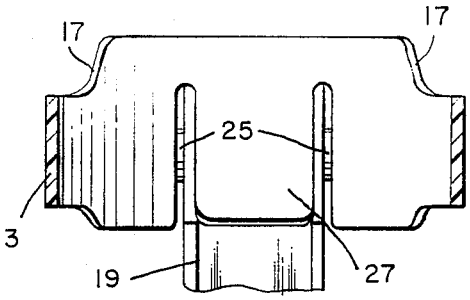
Fig. 4.
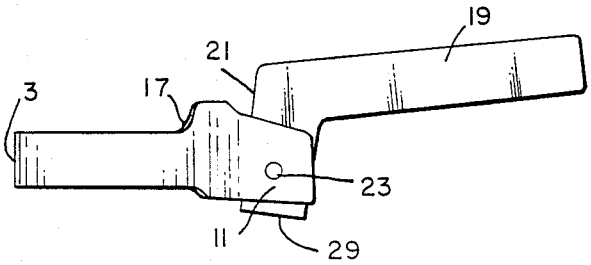
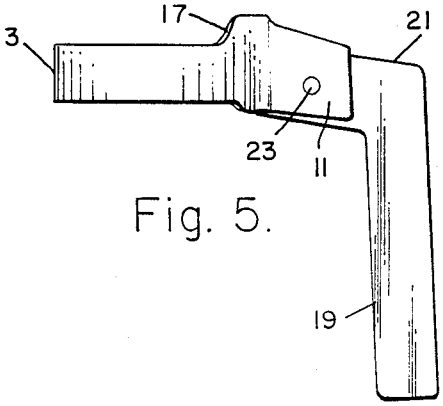
Fig. 5.
Fig. 6.
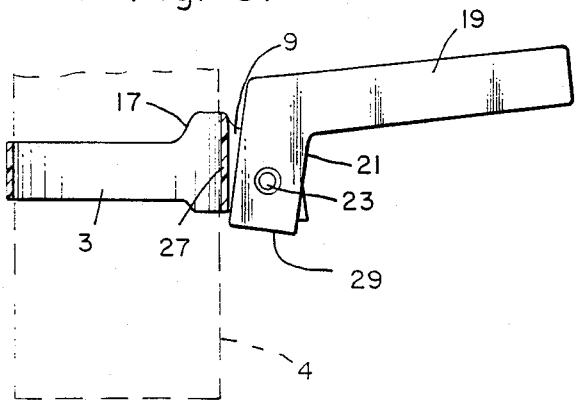
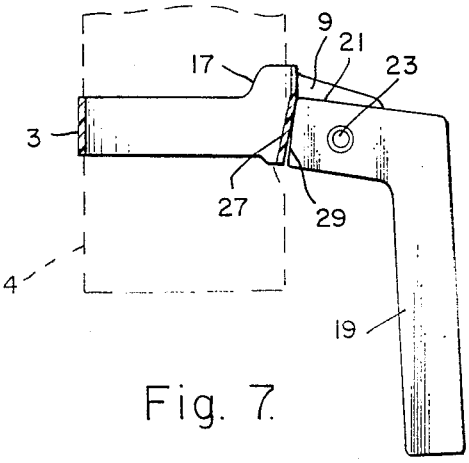
Fig. 7.

CAN HOLDER

TECHNICAL FIELD

This invention relates to means for holding containers, such as aluminum cans for sodas or beer, while allowing a person to consume the contents.

BACKGROUND ART

Considerable innovation has been expended in developing means for holding cylindrical objects, such as tanks and cans. For instance, U.S. Pat. No. 4,560,193 discloses a carrying device for use with a cylindrical tank. It includes a collar which slips around the periphery of the tank, and a handle having a camming edge for displacing a tooth to grip the tank frictionally. The tooth and its projection are not integrally formed in the collar.

U.S. Pat. No. 3,088,767 shows a detachable handle for use with bottles or cans. A collar is fitted around the container and locked there through the camming portion of the handle. The handle, however, has a portion curved back on itself adjoining the flat portion which forms the camming element, creating a spring like action.

U.S. Pat. No. 2,288,359 is directed to a detachable handle for use with cans. This handle is not coupled to a collar but is held to the can by the camming action of a locking lever that is coupled to the handle. The camming action applies pressure to a plate which grips the top flange of the can.

DISCLOSURE OF INVENTION

The present invention is directed to a can holder that is easy and inexpensive to make as well as simple to use. It comprises a collar and a handle. The collar is designed to fit over a can in a snug relationship and has two semirigid lugs integrally mounted on its outer surface with the handle rotatably mounted between them. When the handle is depressed so that its arm is parallel with the side of the can, the proximal end of the handle presses against a portion of the collar that is free to lock against the can.

BRIEF DESCRIPTION OF THE DRAWINGS

FIG. 1 is a perspective view of a can holder of the present invention with a can in place.

FIG. 2 is a top plan view of the can holder of FIG. 1.

FIG. 3 is a cross-sectional view on the line 3—3 in FIG. 2, showing a locking tab.

FIG. 4 is a side view of the can holder of FIG. 1 in the open or receiving position.

FIG. 5 is a side view of the can holder of FIG. 1 in the locked or holding position.

FIG. 6 is a cross-sectional side view of the can holder of FIG. 4 in the open or receiving position with the can in phantom.

FIG. 7 is a cross-sectional view of the can holder of FIG. 5 in the locked or holding position with the can in phantom.

BEST MODE FOR CARRYING OUT THE INVENTION

The invention will now be described with reference to the drawings, wherein the same number refers to the same element throughout.

FIG. 1 is a perspective view of a can holder of the present invention, represented generally at 1 with a can

4 in place. The holder comprises a collar 3 and a rotatable handle 19 having a substantially right angle projection 21. The end of projection 21 near can 4 has camming face 29. The outer surface of collar 3 has two substantially parallel lugs 9 and 11, which are spaced apart to receive projection 21.

Lugs 9 and 11 have pivot holes 15 and 15*a* to receive pivot pin 23. In the illustrated embodiment, pivot pin 2 extends from its seat in pivot hole 15 lug 11 through projection 21 into pivot hole 15*a* in lug 9. Instead of pivot pin 23, projection 23 can be molded with cylindrical protrusions corresponding in size and shape to the portions of pivot pin 23 which extend beyond projection 21. In addition, it is not essential that pivot holes 15 and 15*a* extend all the way through lugs 9 and 11.

As best illustrated in FIG. 2, spacers or washers 25 and 25*a* may be placed on pivot pin 23 on either side of projection 21 to keep the projection properly centered. It is important that camming face 29 of projection 21 rest against locking tab 29 forcing it inward against can 4 when handle 19 is in a downward position as illustrated in FIG. 7. Can 4 is then locked in position and may be tipped so that one can drink from it. When collar 3 is positioned near the top of can 4, recess 17 prevents collar 3 from interfering with the drinker.

When handle 19 is in a raised position as in FIG. 6, there is no pressure against locking tab 27. Because it is made of plastic or metal with some resiliency, tab 27 resumes a relaxed position as an integral part of collar 3. Can 4 may then be removed and a new can inserted into collar 3.

The can holder of this invention is conveniently molded in two sections. One part comprises a collar 3 with two semi-rigid lugs 9 and 11 integrally mounted on its outer surface. Lugs 9 and 11 are substantially parallel to each other and are spaced apart to receive a projection 21 of handle 19. The opposing faces of lugs 9 and 11 are substantially smooth and each has a hole or recess 15 or 15*a* to receive pivot pin 23 or comparable protrusions on projection 19. A flexible locking tab 27 is located on collar 3 between lugs 9 and 11. In a preferred method, holes 15 and 15*a* can be made using an over-under shut off technique. In this event there will be grooves running from the upper edge and the lower edge of lugs 9 and 11 (not shown) terminating in a circular opening in the lugs approximately halfway betweeen the upper edge and the lower edge of each lug. The two grooves on each lug will be on opposite faces of that lug.

The other section of this invention can also be molded in one piece. It comprises handle 19, having a substantially right angle projection 21 at one end. Projection 21 terminates in a camming face 29. Means to rotatably mount this section onto lugs 9 and 11 can be a hole through projection 21 for pivot pin 23 or protrusions that are integrally molded onto the side of projection 21. In the latter case spacers 25 and 25*a* may also be integrally molded onto the protrusions.

ABS and high impact styrene are two plastics from which the sections of this invention can be advantageously molded.

It is to be understood that the device of the present invention may be modified as would occur to one of ordinary skill in the art without departing from the concept and scope of the invention.

INDUSTRIAL APPLICABILITY

The can holder of the present invention can be used with a wide range of containers. It is especially useful with aluminum containers of soda or beer at picnics or other outings where one would not want to use glasses or mugs. It can also be used as an advertising item in that a sponsor's name or slogan can be printed on the collar or the handle.

What is claimed is:

1. A can holder assembly comprising a collar, said collar having an inner surface and an outer surface, two semirigid lugs integrally mounted on said outer surface, said lugs being substantially parallel to each other, spaced apart to receive a handle projection, and having substantially smooth opposing faces, means in each lug to receive rotatably protrusions on each side of said handle projection, said handle projection having a camming face on one end and a handle on the other end, the camming face being located down and away from the collar when the handle is in the raised position and pressing against a locking tab which is an integral part of the collar and located between the lugs when the handle is depressed.

2. A can holder of claim 1 molded from ABS.

3. A can holder of claim 1 having washers on said protrusions to align the camming face with the locking tab.

4. A component for a can holder assembly, said component comprising a collar, said collar having an inner surface and an outer surface, two semi-rigid lugs integrally mounted on said outer surface, said lugs being substantially parallel to each other, spaced apart to receive a handle projection, and having substantially smooth opposing faces, means in said lugs to mount rotatably said handle projection, and a flexible tab integrally formed in said collar between said lugs.

5. A component of claim 4 molded from ABS.

6. A can holder of claim 1 molded from high impact styrene.

7. A can holder of claim 1 having spacers on said protrusions to align the camming face with the locking tab.

8. A component of claim 4 molded from high impact styrene.

* * * * *